United States Patent [19]

Ferrari

[11] Patent Number: 4,902,007

[45] Date of Patent: Feb. 20, 1990

[54] EXERCISING MACHINE OPERABLE TO ASSIST OR RESIST THE EXERCISE

[75] Inventor: Carlo V. G. Ferrari, Alicante, Spain

[73] Assignee: Fittagym Ltd., London, United Kingdom

[21] Appl. No.: 243,439

[22] Filed: Sep. 12, 1988

Related U.S. Application Data

[63] Continuation of Ser. No. 14,070, Mar. 30, 1987, abandoned.

[30] Foreign Application Priority Data

Jun. 6, 1985 [GB] United Kingdom ..... 8514360
Jun. 6, 1986 [WO] PCT Int'l Appl. ... PCT/GB86/00326

[51] Int. Cl.[4] ..... A63B 21/00; A63B 21/06; A63B 21/22

[52] U.S. Cl. ..... 272/126; 272/123; 272/134; 272/138; 272/DIG. 5; 74/101

[58] Field of Search ..... 272/72, 123, 124, 126, 272/134, 135, 116, 137, 138, DIG. 5; 74/99 R, 101, 102-106, 108, 110, 535, 540

[56] References Cited

U.S. PATENT DOCUMENTS 3,976,058 8/1976 Tidwell ..... 272/134 X
4,211,403 7/1980 Coffaro et al. ..... 272/134
4,407,495 10/1983 Wilson ..... 272/134 X
4,422,636 12/1983 de Angeli ..... 272/134 X
4,429,871 2/1984 Flechner ..... 272/134 X
4,493,485 1/1985 Jones ..... 272/126
4,546,971 10/1985 Raasoch ..... 272/134 X
4,616,825 10/1986 Anderson ..... 272/134
4,618,144 10/1986 Gibson ..... 272/134

FOREIGN PATENT DOCUMENTS 2128885 5/1984 United Kingdom .

*Primary Examiner*—Richard J. Apley
*Assistant Examiner*—David J. Bender
*Attorney, Agent, or Firm*—Hopgood, Calimafde, Kalil, Blaustein & Judlowe

[57] ABSTRACT

An exercising machine having improved control permitting either an assist or a resistance of the exercise being performed comprises a first member exercisingly movable by a part of the body against the resistance of a weight or spring and a second member operable by another part of the body with the second member advantageously comprising a pivotable lever, with a linkage selectively engageable between the second member and the weight or spring in two modes in which force applied to the second member in the same direction respectively assists and resists movement of the first member.

7 Claims, 4 Drawing Sheets

FIG.3.a
FIG.3.
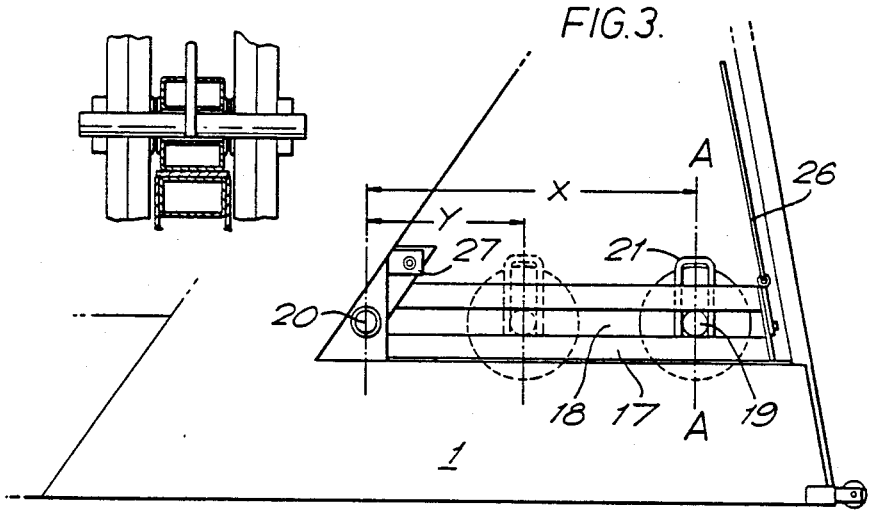
FIG.4a
FIG.4.
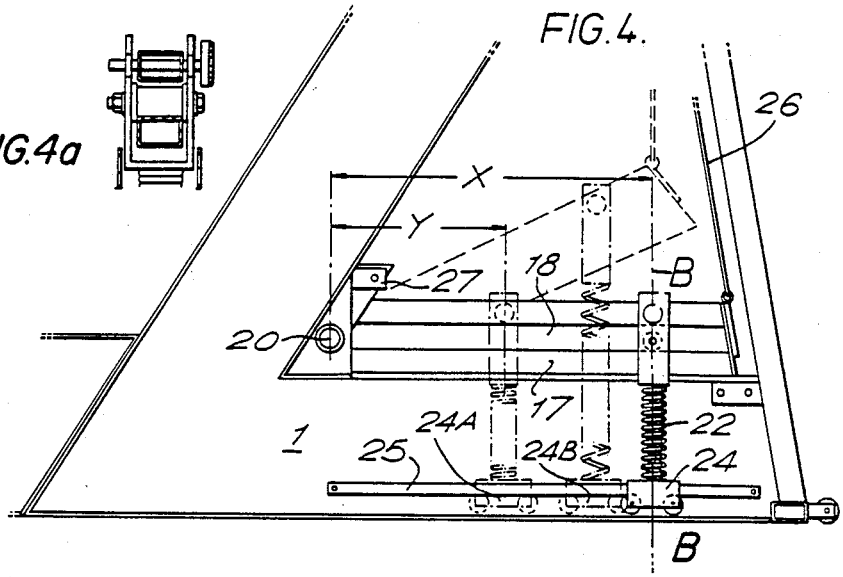

EXERCISING MACHINE OPERABLE TO ASSIST OR RESIST THE EXERCISE

This application is a continuation of copending application Ser. No. 014,070, filed Mar. 30, 1987, now abandoned.

This invention relates to exercise machines of the kind comprising a first member exercisingly moveable by a part of the body against the resistance of a weight or spring, and a second member operable by another part of the body to assist or resist movement of the first member.

Such a machine, henceforth called "of the kind described" is disclosed in United Kingdom Specification No. 2128885A. The machine, enables the user to exercise continual control over the force against which the particular exercise is being performed. The basic resisting force is provided by a weight or a spring, and during the exercise, whether it be a bench press, bicep curl, lateral pull down and so forth, the basic resisting force can be increased or decreased at will by actuation of the second member.

In practice, this facility is very important. For instance, when performing a bench press on a standard bench with a barbell, the maximum effort is required towards the end of the extension. For this reason, when exercising to one's limit it is necessary for other people to stand on either side of the bench to give if necessary a little help to enable the final push through to be made. The machine of the kind described obviates the need for helpers by enabling the exerciser to use his legs to assist the exercise.

Equally the bench presser may find towards the lowering end of the extension or more particularly on lowering the weight that the resistance force is insufficient. With the conventional barbell it is then necessary for an assistant standing by to apply a downward pressure to the middle of the bar. In a machine of the kind described however the user can increase the resistance force by using his legs, but the second member, such as a footplate, must be moved in the opposite direction from that which decreased the resistance force. This is a problem, because when, as in the case of most of the exercises, the user is sitting down, to pull up on the footplate can destabilise the sitting position, and endanger the user. Furthermore, pulling with the feet relies on abdominal muscles not particularly suited for the purpose resulting in the maximum force being low and moreover not readily controllable.

The said control is important because thereby the user is able to develop a force curve which suits them best. Machines are available which produce a force curve dependent on extension, rather than a uniform force, but these machines are not adjustable and therefore must be designed for the average of the intended users. By definition therefore these machines will not suit non-average users, but this is met by machines of the kind described.

We have now discovered that machines of the kind described can be modified according to the present invention to overcome the drawback mentioned above yet retain the other advantageous functions hereinbefore described.

According to the invention there is provided an exercise machine of the kind described including a linkage selectively engageable between the second member and the weight or spring in two modes in which force applied to the second member in the same direction respectively assists and resists movement of the first member.

The advantage of the machine according to the invention will be apparent. Taking the bench press exercise as an example, where the first member is a horizontal bar and the second member a foot pedal, in one configuration of the linkage pushing on the pedal will assist pressing the bar, whereas in the other configuration pushing on the pedal will resist pressing of the bar. Thus depending on the user's requirements, he is able to select either configuration to suit the exercise he wishes to perform.

Preferred features of the invention are as follows:

(1) The second member may comprise a pivotable lever to which the linkage is connectable on either side of the lever's pivotal axis.

(2) The linkage may comprise a pivotable coupling connectable between a pivotable load bar and the second member.

(3) The linkage may include a protruding handle whereby the user is able to move the linkage between said two configurations.

(4) The linkage may have a third configuration in which the second member is disconnected from the load.

(5) The second member may be adapted to selectively receive a foot plate or pedal or a manually actuable bar.

(6) The pivotable load bar may include weight receiving and supporting means adjustably moveable along its length.

(7) The pivotable load bar may include tension or compression spring supporting means and a reaction receiving carriage adjustably moveable along the length of the bar.

(8) The machine may include an overhead instrument bank consisting of one or more meters selected from the range of forcemeter, pulsemeter, stopwatch, repetition counter or the like, whereby the user can monitor his or her exercise.

(9) The machine may comprise a basic chassis including base support, seat, back support, linkage and load bar, to which said first and second members are mountable as desired to perform a selected exercise. Thus a full gymnasium may include many machines having the same basic chassis but with different arrangements of the actuable members for different exercises.

In order that the invention may be readily understood certain embodiments thereof will now be described with reference to the accompanying drawings in which:

FIG. 3 is a scrap side view showing a load bar with weights,

Figure 5:
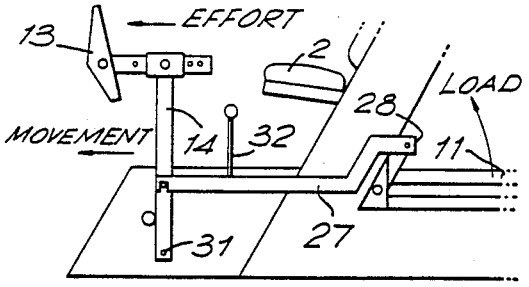
Figure 6:
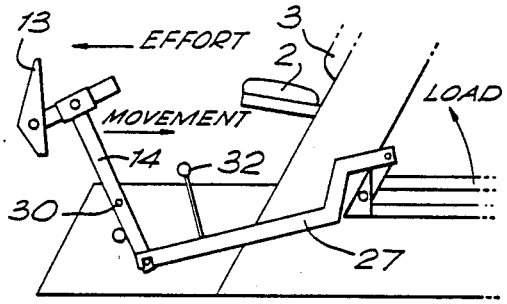
Figure 7:
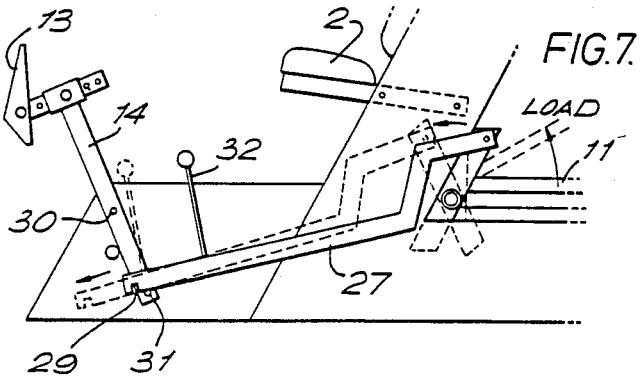
Figure 8:
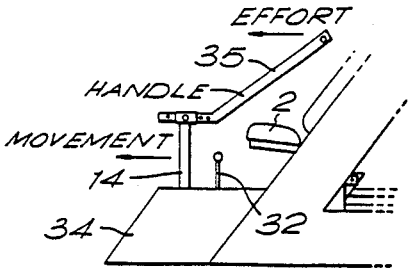

FIG. 3*a* is an enlarged fragmentary sectional detail, taken at A—A in FIG. 3 for the parts relationship of FIG. 3;

FIG. 4 is a scrap side view showing a spring load bar,

FIG. 4*a* is an enlarged sectional detail, similar to FIG. 3*a*, but taken for the parts relationship of FIG. 4 and in the vertical plane B—B of FIG. 4;

FIGS. 5, 6 and 7 are diagrammatic views showing operation of the machine, and FIG. 8 is a diagrammatic view of a modified embodiment.

FIGS. 1–7 show an exercise machine specifically adapted for a bicep curl exercise. It should be noted however that the same basic chassis can be used for machines for other exercises such as bench press, lateral pulldown, tricep curl, forward leg press, shoulder press and many others.

The machine comprises a basic chassis 1 of generally triangular form supporting a seat 2 and inclined bench 3 having lateral arm support pads 4. Beneath the seat 2 are foot rests 5, and overhanging the bench 3 is an instrument bar 6 on which may be fixed instruments 7 such as a stopwatch, repetition counter and the like.

Figure 1:
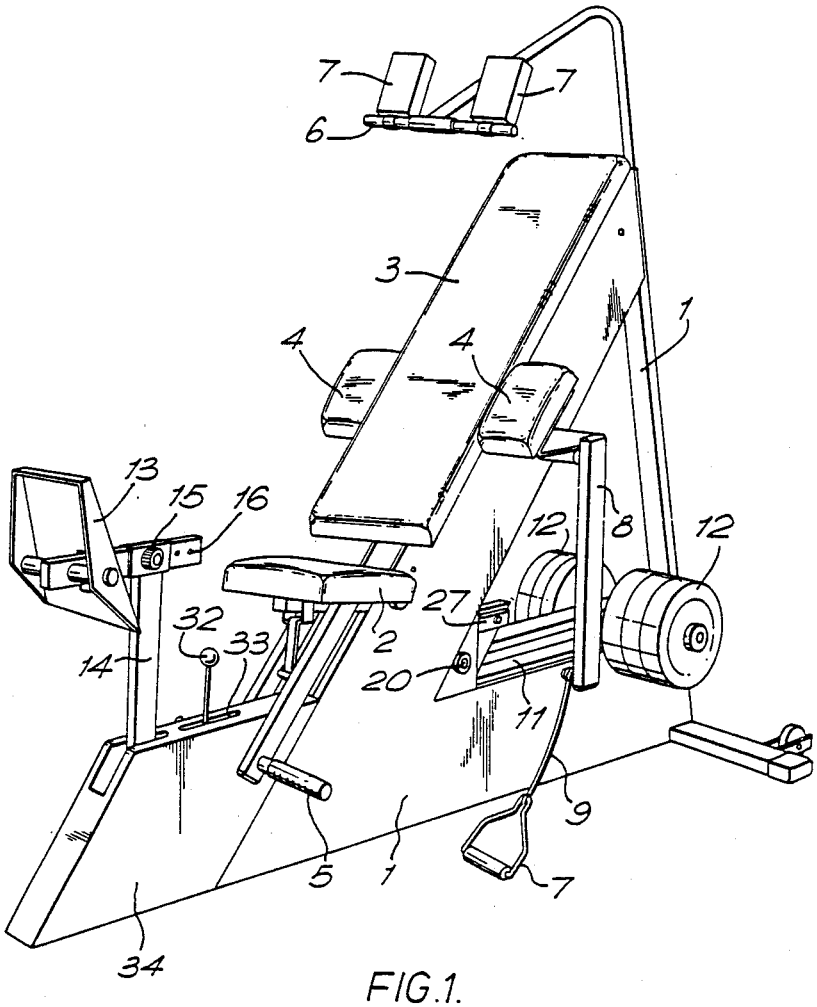
FIG. 1 is a perspective view of one embodiment of machine.
Figure 2:
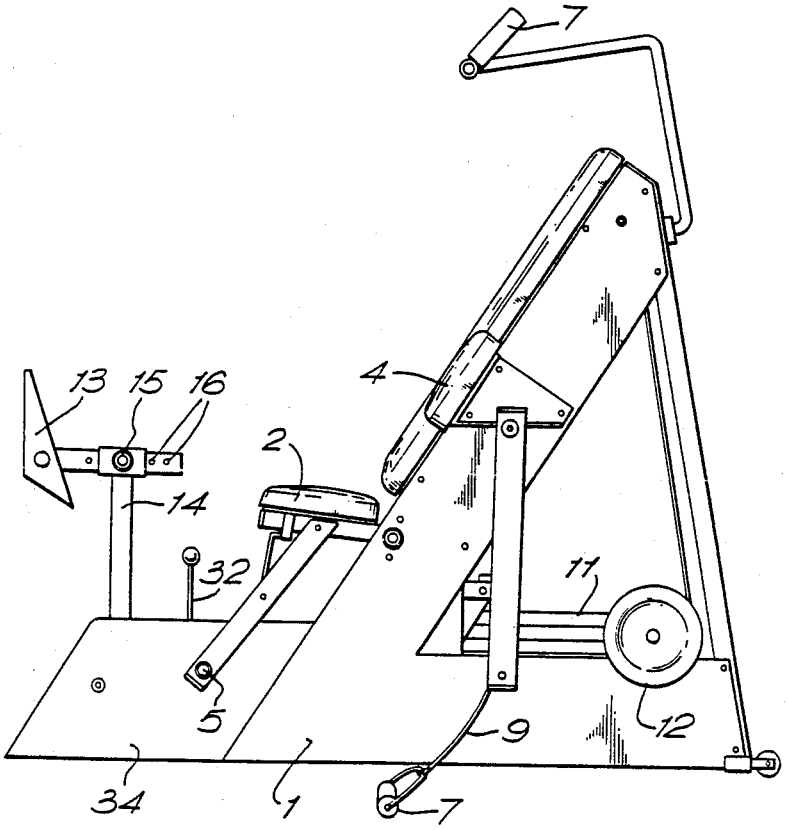
FIG. 2 is a side view.

Depending from the sides of the chassis 1 are pivoted levers 8 mounted on a common axis. To the free end of each lever 8 is connected by a cable 9 a hand grip 10. Pivoting of the levers 8 in the clockwise direction as seen in FIG. 2 causes a pivotable load bar 11 with weights 12 to be raised by means of an interconnecting cable or connecting rod (not shown). The raising or lowering of the bar 11 can be assisted or resisted by pushing forward with the feet on the footplate 13 connected to a second member in the form of a pivotable lever 14 to be described more fully later. The footplate 13 is adjustably secured to the lever 14 by means of a locking shank 15 passing through a selected one of a number of registering apertures 16. By this means the user can adjust the footplate 1 to a comfortable position.

The load bar is shown in more detail in FIG. 3. It consists of a pivotable bar assembly 17 formed with a slot 18 through which passes the bar 19 of a dumbbell. The dumbbell can be moved toward and away from the pivot axis 20 of the bar, being secured in any selected position by a stout staple 21 passing through corresponding apertures (not shown) formed in the bar. Clearly movement of the dumbbell away from the pivot axis 20 will increase the force necessary to raise the bar, and vice versa.

In FIG. 4 the load bar is provided with a tension spring 22 instead of weights. The spring 22 is disposed between a sliding saddle 23 running along the length of the bar and a corresponding reaction carriage 24 running along a fixed rail 25 in the base of the chassis 1. Again, movement of the spring toward and away from the pivotable axis 20 of the bar will vary the effort necessary to raise the bar. The drawing shows at 24A a different position of the spring 22, and at 24B the spring extended by raising of the bar by tension in the lifting cable 26.

As mentioned above, the raising and lowering of the load bar can be assisted or resisted by the footplate/-lever assembly 13/14. This is achieved by means of a linkage 27 which is fixed at one end 28 to the load bar and at the other end contains a slot 29 which is adapted to receive lateral studs 30, 31 mounted on each side of the lever 14. It will be seen that with stud 30 engaged in groove 29 (FIG. 5) pushing forward on the footplate will assist raising of the load bar. On the other hand in the alternative configuration shown in FIG. 6, pushing forward on the footplate resists raising of the load bar. Equally, as shown in FIG. 7 where the groove is engaged with neither stud, pushing forward on the footplate has no effect on raising or lowering the bar, but as the bar is raised and lowered the linkage 27 moves freely between the two positions shown.

The user selects the required configuration of the linkage by means of a handle 32 protruding upwardly from the linkage 27. The handle protrudes through a slot 33 formed in the upper surface of a cowl 34 which houses much of the linkage 27 and lever 14.

It will thus be seen that by pushing on the footplate 13, the user can adjust the effective load on the levers 8 to suit his or her requirements for the exercise. Since pushing with the foot in the same direction can assist or resist lifting of the load bar 11 depending on the configuration of the linkage 27, precise control over the load at any stage in the extension is ensured.

In FIG. 8, the lever 14 has mounted thereto an angled bar 35 provided at its upper end with handles 36. In this way, the assisting or resisting effort is performed with the arms rather than the legs.

It will thus be seen that the invention represents a considerable improvement over previous machines of the kind described.

I claim:

1. An exercise machine comprising:

(a) a base support, (b) a seat mounted on the base support and a back rest mounted adjacent thereto and cooperating therewith to support a user in an exercising position, (c) a load member pivotably connected to the base support and having resistance means selectively and continuously movable theralong to bias the load member about its pivot by a selectively variable couple load, (d) a first exercise member movable by a part of the body to cause the load member to pivot against said resistance means and provide resistance exercise, (e) a second exercise member movable by another part of the body, (f) a rigid linkage connectable between the second exercise member and the load member in first and second selectively available configurations, (g) the linkage in said first configuration being so arranged that force applied to said second member assists movement of the load member against the resistance means, (h) the linkage in said second configuration being so arranged that force applied to said second member in the same direction as said assisting force resists movement of the load member against the resistance means, (i) said second exercise member being a pivotable lever so mounted that in said first configuration said linkage is connected to the lever on one side of its pivot axis and in said second configuration said linkage is connected to the lever on the other side of its axis, and (j) manual actuating means including groove-and-stud engageable means for selective engagement of the linkage to the lever on respective opposite sides of the pivot axis of the lever, whereby the linkage may be readily interchanged between said first and second configurations.

2. An exercise machine according to claim 1, in which the second exercise member has a footplate mounted thereon.

3. An exercise machine according to claim 1, in which the first exercise member has handgrip means connected thereto.

4. An exercise machine according to claim 1 in which said linkage is disposed within a housing of the machine and said manual actuating means consists of a handle connected to the linkage and protruding from said housing.

5. An exercise machine according to claim 1, in which said resistance means comprises a weight bearing carriage movable along said load member.

6. An exercise machine according to claim 1, in which said resistance means comprises spring means extending between the load member and a carriage movable along a guide rail parallel to the load member.

7. An exercise machine according to claim 5 or claim 6, including an overhead instrument bank consisting of a plurality of meters selected from the group consisting of a range-of-force meter, a pulsemeter, a stopwatch, and a repetition counter whereby the user can monitor his or her exercise.

* * * * *